US009919824B2

(12) United States Patent
Potter et al.

(10) Patent No.: US 9,919,824 B2
(45) Date of Patent: Mar. 20, 2018

(54) DEVICE FOR SEALING PACKAGES

(71) Applicant: The Skylife Company, Inc., Rossford, OH (US)

(72) Inventors: Terry C. Potter, Lambertville, MI (US); Andrew E. Potter, Sylvania, OH (US); Matthew J. Medlin, Sylvania, OH (US); Iain A. McNeil, Sylvania, OH (US); Jeffrey J. Potter, Toledo, OH (US)

(73) Assignee: The Skyiife Company, Inc., Rossford, OH (US)

( * ) Notice: Subject to any disclaimer, the term of this patent is extended or adjusted under 35 U.S.C. 154(b) by 449 days.

(21) Appl. No.: 14/687,434

(22) Filed: Apr. 15, 2015

(65) Prior Publication Data

US 2015/0291298 A1 Oct. 15, 2015

Related U.S. Application Data

(60) Provisional application No. 61/979,861, filed on Apr. 15, 2014.

(51) Int. Cl.
*B65B 51/12* (2006.01)
*B65B 51/14* (2006.01)
(Continued)

(52) U.S. Cl.
CPC ..... *B65B 51/12* (2013.01); *B65B 5/00* (2013.01); *B65B 51/14* (2013.01); *B65B 57/02* (2013.01);
(Continued)

(58) Field of Classification Search
CPC ... B65B 51/12; B65B 51/14; B65B 2051/105; B65B 57/02; B65B 57/04
(Continued)

(56) References Cited

U.S. PATENT DOCUMENTS 2,495,486 A 1/1950 Stevenson
2,687,263 A 8/1954 Frieder et al.
(Continued)

FOREIGN PATENT DOCUMENTS

CA 2377291 9/2003
DE 2921109 A1 * 11/1980 ..... B65B 61/00
(Continued)

OTHER PUBLICATIONS

PCT Patentability Report for PCT/US2015/25941, dated Dec. 22, 2015 8 pages.

*Primary Examiner* — Stephen F Gerrity
(74) *Attorney, Agent, or Firm* — Remenick PLLC

(57) ABSTRACT

A cost-effective system and method of sealing that may be a pack adapted to be distributed from an aircraft in the event of a natural, military, political, or other disaster is described herein. The system comprises a conveyor belt and a sealing mechanism positioned above the conveyor belt. The sealing mechanism is comprised of a motor, a drive shaft rotated by the motor, an eccentric hub coupled to the drive shaft, a drive link coupled to the eccentric hub and adapted to translate rotational motion into liner motion, a pivot arm coupled to the drive link, and a sealing bar coupled to the pivot arm and adapted to seal the packages as the packages pass under the sealing mechanism.

11 Claims, 14 Drawing Sheets

(51) Int. Cl.

| | |
|---|---|
| ***B65B 57/02*** | (2006.01) |
| ***B65B 5/00*** | (2006.01) |
| ***B65D 81/03*** | (2006.01) |
| *B65D 30/00* | (2006.01) |
| *B65D 77/04* | (2006.01) |

(52) U.S. Cl.
CPC ..... *B65D 81/03* (2013.01); *B65D 29/00* (2013.01); *B65D 77/04* (2013.01)

(58) Field of Classification Search
USPC ..... 53/373.7, 374.3, 374.5, 374.6, 374.8, 53/374.9, 76
See application file for complete search history.

(56) References Cited

U.S. PATENT DOCUMENTS 2,790,284 A 4/1957 Hultkrans
3,050,278 A 8/1961 Gardner et al.
3,012,387 A * 12/1961 Jacobs et al. ..... B65B 51/14 156/515
3,097,462 A * 7/1963 Langdon ..... B65B 9/026 53/374.8
3,115,831 A 12/1963 Suter
3,168,267 A 2/1965 Ferris et al.
3,279,594 A 10/1966 Worthington
3,284,987 A * 11/1966 Sigmon ..... B29C 65/18 53/374.9
3,401,905 A 9/1968 Rohrlick
3,446,458 A 5/1969 Rogallo
3,491,632 A 1/1970 Dovey et al.
3,522,129 A * 7/1970 Crathern, III ..... B32B 38/1841 156/364
3,551,261 A * 12/1970 Histed ..... B29C 65/18 156/498
3,724,788 A 4/1973 Petry et al.
3,818,129 A 6/1974 Yamamoto
3,869,842 A 3/1975 Verbeke
3,886,713 A * 6/1975 Mitchell et al. ..... B29C 65/749 53/373.4
4,121,755 A 10/1978 Meseke et al.
4,241,890 A 12/1980 Pearson
4,262,473 A * 4/1981 Brooke ..... B65B 9/20 53/450
4,349,168 A 9/1982 Barnes
4,374,578 A 2/1983 Banks
4,624,407 A 11/1986 Janhonen
4,870,802 A * 10/1989 Cerf ..... B65B 9/02 53/373.9
4,903,460 A * 2/1990 Ballestrazzi et al. ... B29C 65/02 156/512
5,269,119 A 12/1993 Tolson
5,295,580 A 3/1994 Hicks
5,653,085 A * 8/1997 Suga ..... B29C 65/7451 53/374.5
5,675,958 A * 10/1997 Shanklin et al. ..... B65B 51/303 53/374.6
5,771,660 A * 6/1998 Loewenthal ..... B29C 65/18 53/374.5
5,771,667 A 6/1998 McGregor et al.
5,779,052 A 7/1998 Woodford et al.
5,809,380 A * 9/1998 Katakabe et al. . G03G 15/0121 399/167
5,924,546 A * 7/1999 Funaya ..... B65G 47/256 198/395
5,947,419 A 9/1999 Warren et al.
6,003,706 A 12/1999 Rosen
6,098,798 A 8/2000 Abbott
6,231,284 B1 5/2001 Kordel
6,564,527 B1 * 5/2003 Focke et al. ..... B65B 57/02 53/136.1
6,595,344 B1 7/2003 Davis et al.
6,712,317 B1 3/2004 Warren et al.
6,817,578 B1 11/2004 Garcia et al.
8,047,976 B2 * 11/2011 Holbrook et al. ..... B41J 11/007 53/76
8,979,030 B2 3/2015 Potter et al.
9,296,470 B1 3/2016 Moselage, III
9,821,484 B2 * 11/2017 Este et al. ..... B65B 57/02
2003/0197095 A1 10/2003 Preston
2003/0234290 A1 * 12/2003 Good et al. ..... G02B 26/106 235/462.14
2004/0051006 A1 3/2004 Warren et al.
2005/0029335 A1 2/2005 Abernathy
2006/0025293 A1 2/2006 Moen
2007/0125212 A1 * 6/2007 Hilgendorf ..... B26D 1/157 83/408
2007/0164023 A1 7/2007 Lapoint
2008/0219830 A1 9/2008 Wells
2009/0272852 A1 11/2009 Reynolds et al.
2011/0031170 A1 * 2/2011 De Roo ..... B65B 57/02 209/552
2011/0133036 A1 6/2011 Goddard et al.
2012/0043426 A1 2/2012 Potter et al.
2012/0073245 A1 * 3/2012 Uttaro et al. ..... B26D 1/565 53/450
2012/0325693 A1 12/2012 Mooney et al.
2013/0334371 A1 12/2013 Potter et al.
2014/0263840 A1 9/2014 Potter et al.
2015/0353214 A1 * 12/2015 Gerstner et al. ..... B65B 61/025 53/411

FOREIGN PATENT DOCUMENTS

DE 3024517 A1 * 1/1982 ..... B65B 51/14
DE 19940743 4/2000
EP 1375123 A1 * 1/2004 ..... B65B 51/146
GB 776950 6/1957
GB 00829401 3/1960
GB 2030514 A * 4/1980 ..... B29C 65/18
JP 2309981 12/1990
WO WO03016135 2/2003

* cited by examiner

DEVICE FOR SEALING PACKAGES

CROSS REFERENCE TO RELATED APPLICATIONS

This application claims priority to U.S. Provisional Application No. 61/979,861, filed Apr. 15, 2014, entitled "Remote Packing System." The entire disclosure of which is hereby incorporated herein by reference.

BACKGROUND

1. Field of the Invention

The present invention relates to methods and systems for manufacturing packs. More particularly, the invention is directed to cost-effective methods and systems for manufacturing packs adapted to be distributed from an aircraft.

2. Description of the Background

Numerous circumstances require the transport and delivery of various kinds of cargo to inaccessible or remote areas where ground transportation is not possible or timely. For example, in the event that people are trapped or disabled in a remote area, a hostile environment, or an area ravaged by a natural disaster, it may become necessary or desirable to supply them with food, water, medicine, shelter, and other supplies as rapidly as possible. Similarly, in times of warfare, battlefields may be in remote locations or hostile environments. Likewise, it may be necessary to deliver supplies such as fuel to stranded people. Of course, in times of war or other hostilities, it may be essential to provide support to permit the stranded personnel to evacuate the position in which they find themselves.

Many remote locations or hostile environments may be in areas such as deserts or large expanses of otherwise uninhabited or inhospitable terrain. Because of the remoteness of a location or its inaccessibility, supplies are often delivered by air drops from airplanes or helicopters. In the event of natural disasters and other emergencies, time may be of the essence to deliver sustenance, medicine, or other critical items to people cut off from life-sustaining supplies. For example, it might be essential to provide water to people cut off from a clean water supply in the event of flooding, an earthquake, and/or a hurricane.

While in an emergency, the cost of packaging and delivering supplies to those in need may be considered secondary, it is nevertheless important to provide packaging for the supplies that can be formed and distributed on a reasonably cost-effective basis. Also, the space taken up by the containers or packages, as well as the amount and cost of material from which the containers are fabricated, should be minimized to increase the cost effectiveness thereof.

In the past, relief supplies have been delivered by dropping pallets of supplies by parachutes connected to containers. Typically, large amounts of supplies are stacked on multiple pallets and parachutes are connected to the pallets. However, parachutes are expensive and are typically not recoverable. Moreover, the parachutes may be quite large and cumbersome. The size of the parachutes depends on the particular supplies to be distributed. If the parachutes are undersized, the containers descend at a rapid rate and the container may be ruptured and the contents thereof lost, or people on the ground may be harmed by the rapidly-descending containers. Furthermore, if the supplies are stacked together on a pallet and the pallet air drop is off target, the supplies may be unrecoverable by those in need. Even if the pallet of supplies is recoverable, bandits or guerillas have been known to hoard the supplies and either keep them from people in need or ransom the supplies.

There is a continuing need for a cost-effective package for emergency supplies that may be easily air dropped and distributed to a large number of people with a minimized risk of damage to the supplies and harm to the people collecting the supplies. Additionally, there is a continuing need for a method and system for manufacturing the packages.

SUMMARY OF THE INVENTION

In concordance with the instant disclosure, a cost-effective method and system for manufacturing packs has surprisingly been discovered.

One embodiment of the invention is directed to a device for sealing packages. The device comprises a conveyor belt and a sealing mechanism positioned above the conveyor belt. The sealing mechanism is comprised of a motor, a drive shaft rotated by the motor, an eccentric hub coupled to the drive shaft, a drive link coupled to the eccentric hub and adapted to translate rotational motion into liner motion, a pivot arm coupled to the drive link, and a sealing bar coupled to the pivot arm and adapted to seal the packages as the packages pass under the sealing mechanism.

Preferably the device also comprises guides coupled to the conveyor belt adapted to position the packages under the sealing mechanism. In a preferred embodiment, the sealing mechanism further comprises a strip brush coupled to the pivot arm and adapted to close each package as the package is sealed. The sealing mechanism is preferably one of electrically driven or pneumatically driven. Preferably the conveyor belt is positioned on a stand and the stand is movable.

Preferably the sealing mechanism further comprises an imaging device adapted to determine if a package is properly positioned under the sealing mechanism prior to sealing the package. The imaging device is preferably a laser and the sealing mechanism further comprises guide wheels, wherein at least one guide wheel is notched to allow the laser to pass through the guide wheel uninterrupted.

In a preferred embodiment, a plurality of packages are sealed continuously without stopping or slowing the conveyor belt. Preferably, the sealing bar applies heat to each package to seal the package. The packages are preferably automatically or manually filled prior to being sealed. Preferably, the packages are only open along one edge prior to being fed into the device. In a preferred embodiment, an operator of the device is able to control at least one of a conveyor speed, a sealing time, a run time, and a temperature of the sealing.

Other embodiments and advantages of the invention are set forth in part in the description, which follows, and in part, may be obvious from this description, or may be learned from the practice of the invention.

DESCRIPTION OF THE INVENTION

Figure 1:
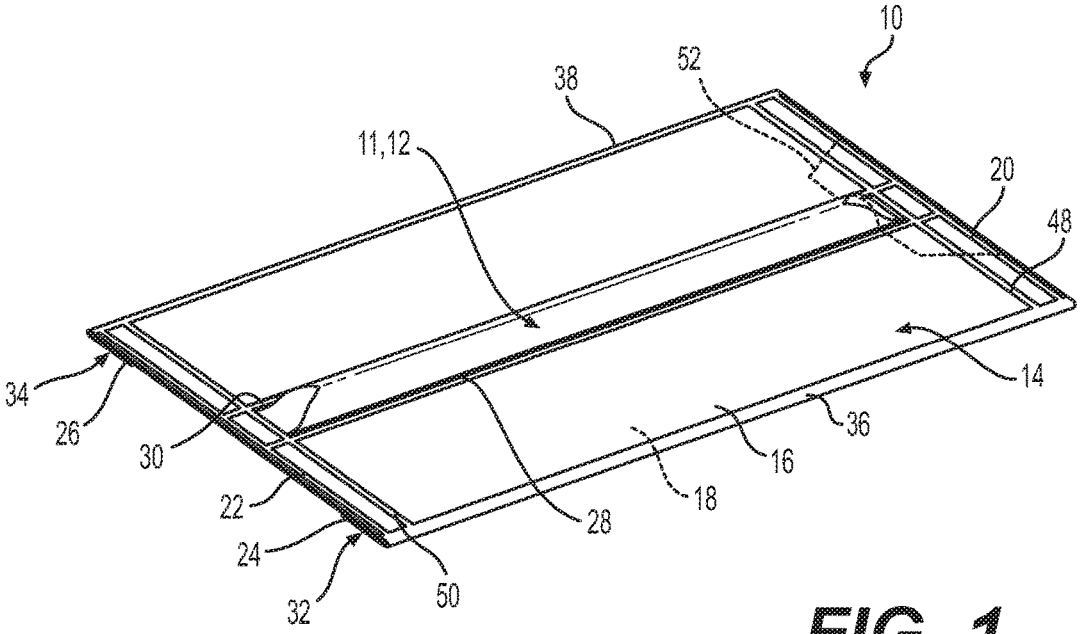
FIG. 1 is a top perspective view of an emergency pack according to one embodiment of the disclosure, the emergency pack shown in a formed position.

Providing supplies to a population under emergency conditions is an extremely risky undertaking. Typically, transportation infrastructures have been disrupted, for example, by natural disasters or political or social upheaval. It is often difficult or impossible to truck relief supplies to the disaster area because roads are destroyed and/or access points are blocked. In addition, the relief workers themselves are placed in danger, which may be from environmental concerns (e.g. floods, mudslides, earthquakes, radiation) or dangerous military actions on the ground. Providing supplies by air is often the only viable option in a disaster, but there are still many problems. Because supplies are provided in bulk, the process generally requires precise targeting and coordination with those on the ground to avoid damage to the supplies themselves, damage to structures on the ground, and harm to persons and animals. Whether delivered by truck, ship, or aircraft, supplies are often stolen or confiscated by governments or persons wishing to establish regional political or military dominance. Consequently, the cost of delivery is high and the effectiveness of providing real relief is minimal.

It has been surprisingly discovered that a cost-effective pack of supplies can be manufactured and air dropped for distribution to large numbers of people with a minimized risk of damage to structures on the ground, to the supplies themselves, and with minimal risk of harm to people and animals on the ground, all while maximizing the receipt of supplies to those in limited area. While weather conditions can still be problematic, when known or predicted in advance, specific aerodynamic components can be configured by one skilled in the art to adjust the trajectory of the packs and therefore account for expected transverse movement of the pack through the air while descending. Also, pack distribution can be monitored by radar (e.g. doppler) or tracking devices within each pack (e.g. GPS) to plot broadcast distribution patterns over various terrain and in various weather conditions. Those patterns can be used to determine optimal distribution or determine if re-distribution is necessary. Design configurations may include, for example, ailerons and rudder structures that may be fixed to predetermined positions, wings and/or leading edges set at a predetermined shape or angle of attack, asymmetric loading of the supplies in the pack itself and/or combinations thereof.

Alternatively, packs and also boxes containing multiple packs may be rendered transparent or invisible to radar by coating pack and/or box walls with radar absorbing materials such as, for example, carbon fiber and/or carbon nanotubes including single-walled, double-walled and/or multi-walled carbon nanotubes. Walls may also be angled to provide packs and/or boxes with a low radar profile. Packs and/or boxes may also be camouflaged with color to render packs invisible from the ground or at least difficult to spot and track in the air as they descend. Preferred colors include traditional camouflage patterns, or solid colors or patterns of sky blue, snow white, gray, brown, green, sand colored, dark blue, and black. Packs and/or boxes may also be colored differentially so that the chosen color renders the pack largely invisible when looking up and difficult to see when on the ground such as, for example, by using boxes with sky blue bottom and black tops.

Preferably, packs, including the aerodynamic components, are manufactures as single units to minimize manufacturing costs. Also preferable, supply items are inserted into the packs during the manufacturing process, again to minimize costs.

As embodied and broadly described, the disclosures herein provide detailed embodiments of the invention. However, the disclosed embodiments are merely exemplary of the invention that is embodied in various and alternative forms. Therefore, there is no intent that specific structural and functional details should be limiting, but rather, the intention is that they serve as a representative basis for teaching one skilled in the art to variously employ the present invention.

FIG. 1 illustrates a pack 10 with an item 11 for aerial delivery. The pack 10 includes an inner package 12 and an outer package 14. The inner package 12 may be disposed along a substantially central longitudinally extending axis of the outer package 14, for example. The inner package 12 either is the item 11 for aerial delivery, or houses the item 11 for aerial delivery. For example, the item 11 may be a mosquito net or water disposed in the inner package 12. In the embodiment shown, each of the inner package 12 and the outer package 14 of the pack 10 has a quadrilateral shape in plan view. It should be appreciated that the inner package 12 and the outer package 14 may have other shapes in plan view, such as a circle, an oval, a triangle, an asymmetrical shape, and the like, as desired. Likewise, an overall size of the pack 10 will depend on a number of factors, including the size and weight of contents of the inner package 12, including the item 11 for delivery. In a preferred embodiment, the dimensions of the outer package are 300 mm by 150 mm, 350 mm by 200 mm, 400 mm by 300 mm, 450 mm by 200 mm, or another size. The ratio of size to weight can be adjusted as required to change the aerodynamic features of the pack 10.

The outer package 14 may be formed from a polymeric material, such as polyethylene, for example. In certain embodiments, the outer package 14 is formed from a biodegradable material, such as, for example, a polyvinyl alcohol (PVA), polyethylene (PE), polypropylene (PP), or polystyrene (PS). Plastic boxes have the advantage of allowing for extrusion manufacturing and sealing of the boxes with heat to fuse the plastic materials providing a barrier to moisture and other substances, e.g., rendered water-tight. In preferred embodiments, the outer package 14 may also be formed from a mesh material. In preferred embodiments, the outer package 14 is formed from a high performance barrier plastic. For example, the high performance barrier plastic can be an oxygen or carbon dioxide scavenger or barrier. Additionally, outer package 14 may be made of numerous layers and/or corrugated to provide strength. For example, outer package 14 may have inner and outer layers of polyethylene and a middle layer of rip-stop nylon. In preferred embodiments, outer package 14 may be coated with a low friction coating (e.g. a lubricant, talcum powder, Teflon, an oil, or graphite). Furthermore, there may be adhesive between the layers, layers that promote heat seals, and layers that provide optical clarity or opaqueness. Furthermore, the thickness of outer package 14 can vary depending on the desired attributes of the pack 10. A skilled artisan may select suitable materials and number of layers for the outer package 14, as desired.

The inner package 12 is disposed inside the outer package 14. Where the inner package 12 houses item 11, the contents of the inner package 12 may dictate the particular material used to form the inner package 12. For example, the material forming the inner package 12 may be dictated by a desired shelf-life and storage time of the item 11 housed by the inner package 12. In preferred embodiments, the inner package 12 is formed from a polymeric material, such as, for example, PE, PVA, PS and/or PP. The inner package 12 may alternatively be formed from any conventional material known in the packaging industry, materials such as a cardboard, a metal, a plastic, a fabric or a combination of the foregoing, as examples. Furthermore, inner package 12 may be made of or contain a cushioning material. For example, inner package 12 may be formed from bubble wrap or foam.

As non-limiting examples, the inner package 12 may contain or be non-perishable items 11, such as mosquito netting, a blanket, tools, illuminating devices, batteries, tents or other shelter, rain suits or other clothing and foot protection, toilet tissue, cleansing wipes, ammunition, dental hygiene supplies, parts required for vehicle or equipment repair, hunting and fishing tools, water purification pills, a filtered drinking straw to remove contaminants from water, communication and/or navigation devices, heating devices such as those chemically activated to generate heat, and video or paper informational instructions furnished to victims of a natural disaster or war. Other types of non-perishable items 11 may also be housed by the inner package 12, within the scope of the present disclosure.

Where the contents of the inner package 12 are non-perishable, the inner package 12 may particularly be formed from a biodegradable material, such as a polyvinyl alcohol (PVA), for example, or from a perforated material. Furthermore, the inner package 12 may include one or more tabs coupled to each end of the item 11 contained therein and to the outer package 14. The tabs facilitate a removal of the inner package 12 from the outer package 14, for example.

The inner package 12 may also be used for delivery of perishable items 11. For example, the inner package 12 may contain a food or a liquid that requires a substantially fluid and/or light and/or air impermeable material. Where the contents of the inner package 12 are temperature or light sensitive, such as a medication, or flammable, such as fire-starting kits, magnesium blocks for starting fires, or fuels, the inner package 12 may be formed from a thermally insulating material, for example, a metallic or composite foil. The inner package 12 may also include a heating or cooling substance or a device to maintain the contents of the inner package 12 at a desired temperature. The heating or cooling substance or device may also be contained by the outer package 14 and not merely the inner package 12. Medicinal contents of the inner package 12 may include insulin, tetanus vaccinations, Dengue-fever vaccinations, malaria vaccinations, antibiotics, and the like, as non-limiting examples. Other types of perishable items 11 may also be housed by the inner package 12, as desired.

The outer package 14 and the inner package 12 may be formed from the same material or from different materials, as desired. A skilled artisan may select suitable materials for the inner package 12 and the outer package 14, as desired.

Figure 4:
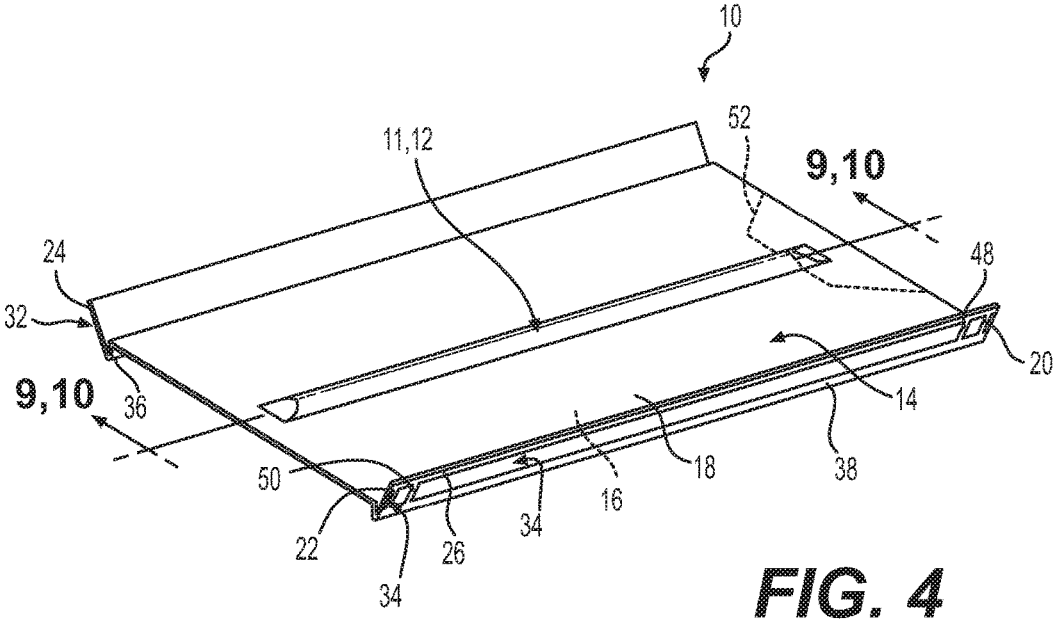
FIG. 4 is a bottom perspective view of the emergency pack illustrated in FIGS. 1-3, the emergency pack shown in a flight position.
Figure 5:
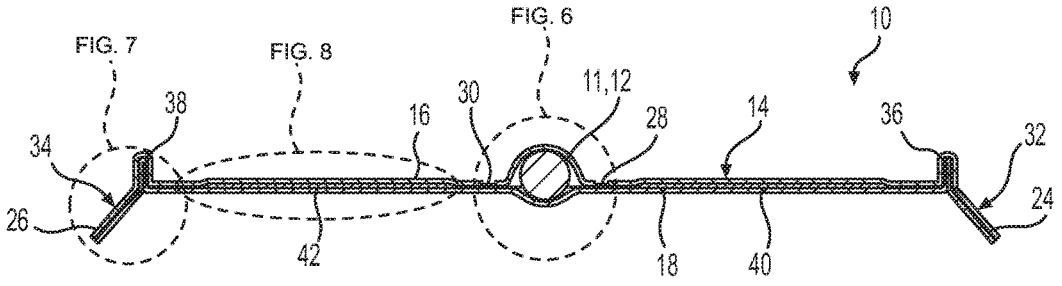
FIG. 5 is a cross-sectional front elevational view of the emergency pack taken at section line 5-5 in FIG. 3.
Figure 6:
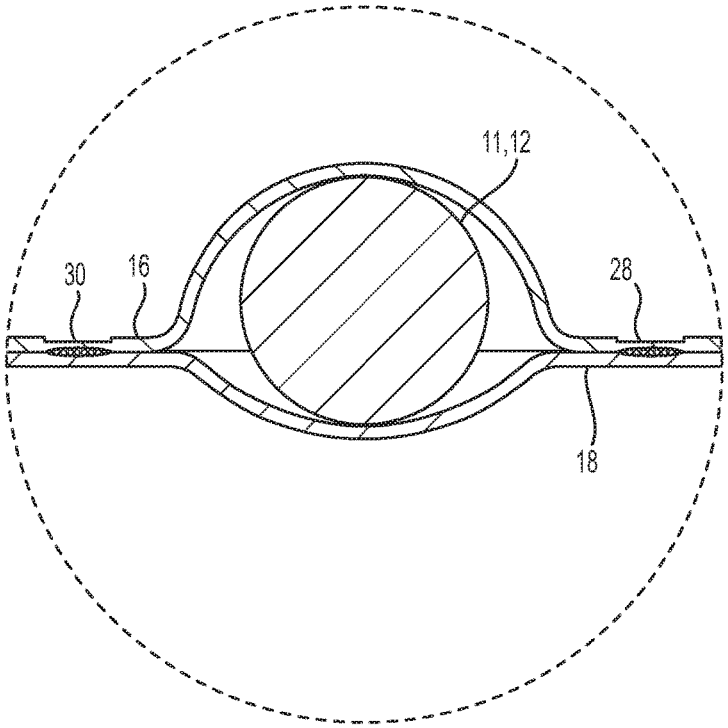
FIG. 6 is a fragmentary enlarged cross-sectional front elevational view of the emergency pack taken at callout FIG. 6 in FIG. 5, further showing an inner package of the emergency pack.

With renewed references to FIGS. 1-10, the outer package 14 is formed from a pair of superposed sheets 16, 18, having facing surfaces that are joined together. The top edges of the sheets 16, 18 are sealed together to form a top edge seal 20 of the pack 10. Likewise, the bottom edges of the sheets 16, 18 are sealed together to form a bottom edge seal 22 of the pack 10. The side edges of the sheet 16 are sealed to corresponding side edges of the sheet 18 to form a pair of opposing side edge seals 24, 26 of the pack 10. The facing surface of the sheets 16, 18 adjacent the inner package 12 are sealed together to form mid-pack seals 28, 30 of the pack 10. The top edge seal 20, the bottom edge seal 22, and the mid-pack seals 28, 30 confine the inner package 12 within the outer package 14, for example, as shown in FIG. 6.

Figure 2:
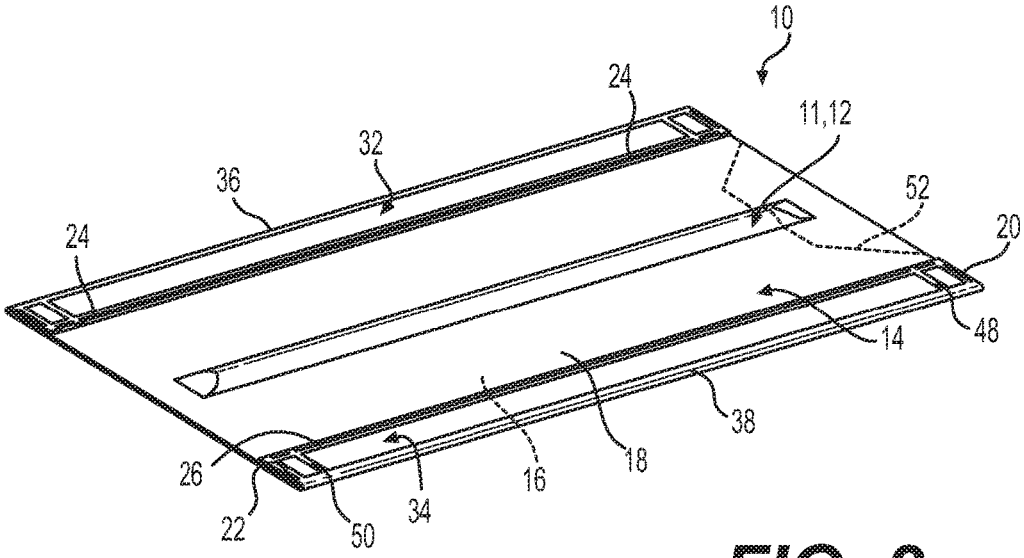
FIG. 2 is a bottom perspective view of the emergency pack illustrated in FIG. 1, the emergency pack shown in a formed position.
Figure 3:
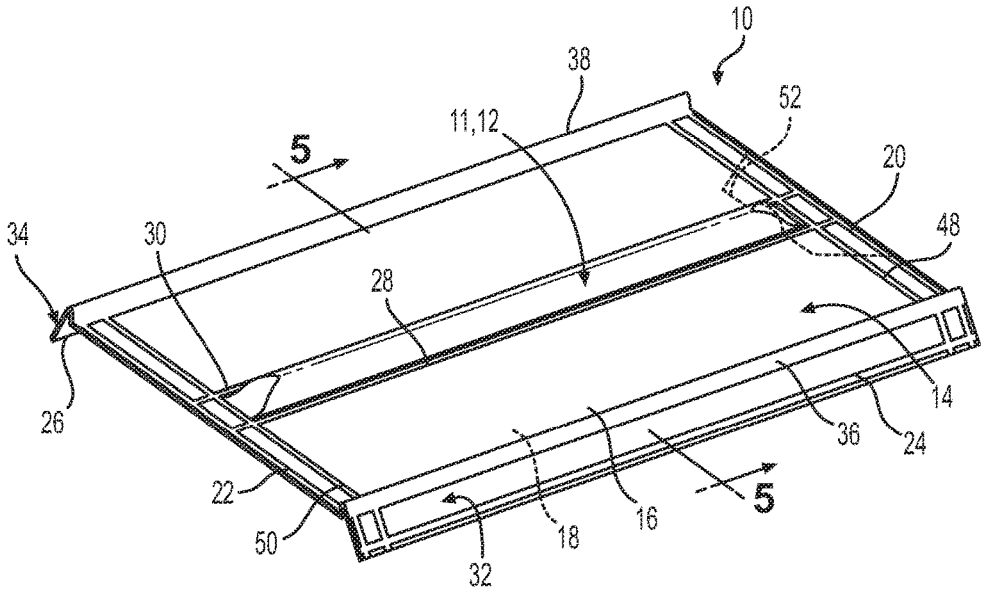
FIG. 3 is a top perspective view of the emergency pack illustrated in FIGS. 1-2, the emergency pack shown in a flight position.
Figure 7:
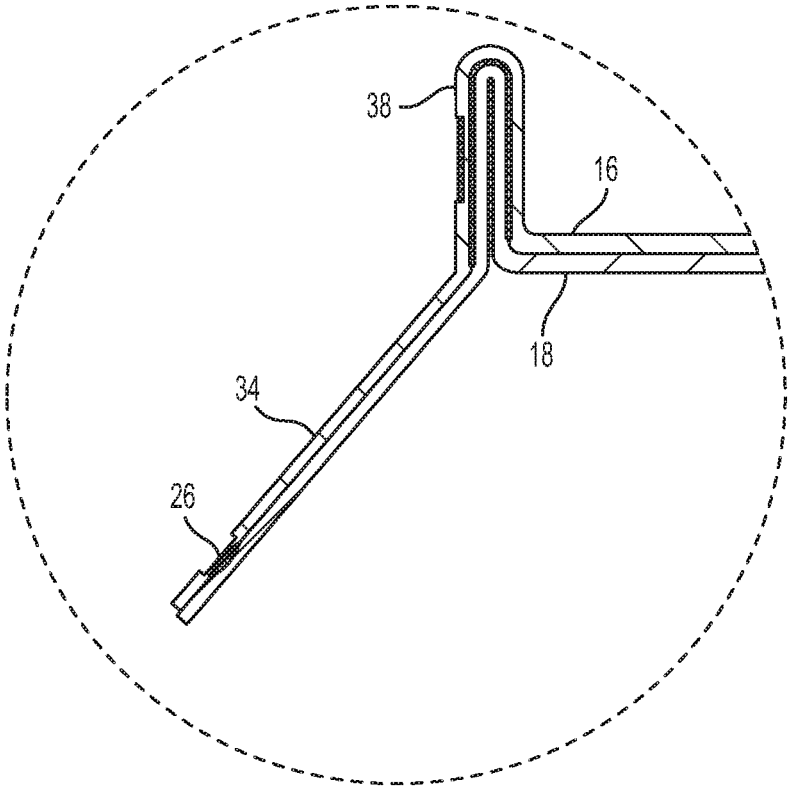
FIG. 7 is a fragmentary enlarged cross-sectional front elevational view of the emergency pack taken at callout FIG. 7 in FIG. 5, further showing a wing of the emergency pack.

The outer package 14 includes at least one aerodynamic component 32, 34. Aerodynamic component 32, 34 preferably creates drag during the free fall of pack 10 during use thereby slowing the descent of pack 10. Additionally, aerodynamic component 32, 34 may provide aerodynamic and stability characteristics such as lift, directional control, thrust, or weight. In the embodiment shown in FIG. 1-10, the at least one aerodynamic component 32, 34 includes a pair of flanges or wings 32, 34 formed between the side edge seals 24, 26 and the mid-pack seals 28, 30 of the pack 10. The wings 32, 34 are formed by folding corresponding side edges of the sheets 16, 18 and sealing the folded edges to form wing seals 36, 38, for example, as shown in FIGS. 5 and 7. As a result of sealing the folded edges to form the wing seals 36, 38, the wings 32, 34 normally are closed and extend inwardly along a longitudinal axis of the pack 10. The wings 32, 34, which as shown in FIGS. 1-2 are normally closed in the pack 10, unfurl as shown in FIGS. 3-4 as the pack 10 is dropped through the air. While two wings 32, 34 are depicted, any number of wings can be used.

The at least one aerodynamic component 32, 34 may advantageously cause turbulent flow, as opposed to laminar flow, across the outer package 14 and decrease a descent rate of the pack 10 in operation. Preferably, the velocity of pack 10 is reduced from freefall to, for example, 20 meters per second, 15 meters per second, 10 meters per second, 8 meters per second, or 5 meters per second. Preferably, the impact with the ground of pack 10 is reduced from the impact of the pack with ground during freefall, for example, by 90%, 75%, 60%, 50% or another percentage. Although the embodiments shown in FIGS. 1-10 include wings 32, 34 as the at least one aerodynamic component 32, 34, one of ordinary skill in the art should understand that the at least one aerodynamic component 32, 34 may alternatively include a tail, a fin, an airfoil, a parasail, a parachute, rotary blades, streamers or a tail, or other structure adapted to create drag when the pack 10 is dropped through the air. As a non-limiting example of other types of structure, tunnels, dimples, vent slits, scalloped or serrated edges, or holes formed in the outer package 14 may be used to for create turbulent flow. Suitable aerodynamic component 32, 34 for the pack 10 may be selected, as desired. Furthermore, a combination of aerodynamic elements can be used. For example, holes can be punched into wings 32, 34 to further control drop rate and/or flight characterizes. The pack may include air vents that allow a portion of air the air passing over pack 10 to, instead, pass though pack 10 as pack 10 descends.

In certain embodiments, the aerodynamic component 32, 34 controls the flight path of the pack 10. For example, wings may be formed to force the pack 10 to follow a spiral descent, a zigzag descent, or a descent similar to an airplane that is landing. Such controlled descent improves the accuracy of delivering packs 10 to a desired location.

Figure 8:
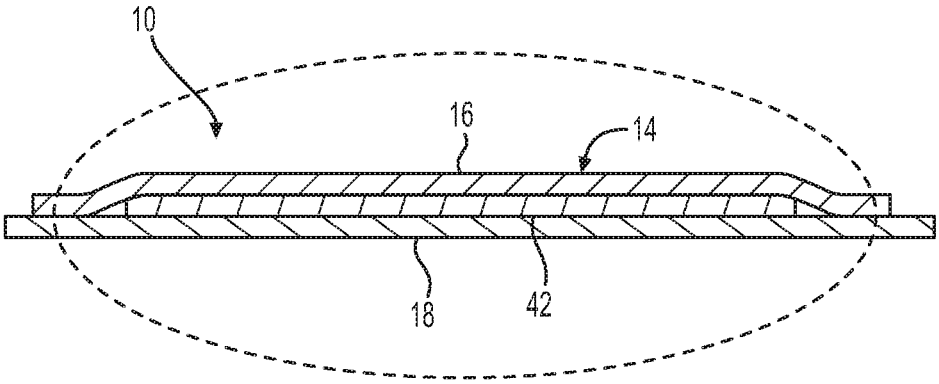
FIG. 8 is a fragmentary enlarged cross-sectional front elevational view of the emergency pack taken at callout FIG. 8 in FIG. 5, further showing a rigid insert in an outer package of the emergency pack.

In certain embodiments, the outer package 14 is formed from a substantially rigid material adapted to mitigate against a folding of the pack 10. With reference to FIGS. 5 and 8, the outer package 14 may also include at least one rigid insert 40, 42 adapted to provide structural support to the outer package 14 and militate against an undesirable folding of the pack 10 in operation. For example, the rigid inserts 40, 42 may be elongate members sealed and disposed between the mid-pack seals 28, 30 and the wing seals 36, 38 of the outer package 14. The rigid inserts 40, 42 may include ribs laterally oriented within the outer package 14, or supports longitudinally oriented within the outer package, for example. The rigid inserts 40, 42 may also be coupled to the outer package 14 during the formation of the top edge seal 20 and the bottom edge seal 22. It is understood that the inserts 40, 42 may be coupled to the top edge seal 20 and the bottom edge seal 22, as desired. The inserts 40, 42 may also be disposed adjacent the inner package 12 or coupled to an exterior of the outer package 14. In a preferred embodiment, the rigid inserts 40, 42 may include stiff or folded paper informational instructions for users of the contents of the pack 10. In other embodiments, the rigid inserts 40, 42 are cardboard or plastic inserts having a stiffness sufficient to militate against a folding of the outer package 14. One of ordinary skill in the art may select a suitably rigid material for the inserts 40, 42, as desired with maintaining the desired flexibility. Outer package 14 can also have embossed surfaces, vacuum sealed portions, pressurized chambers and/or chambers filled with gas (e.g. helium, hydrogen, or air) to adjust the stiffness of the pack 10.

Figure 9:
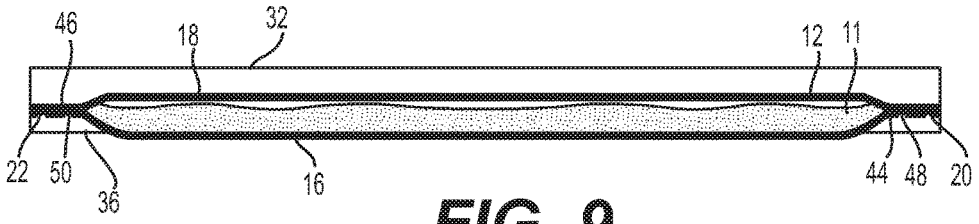
FIG. 9 a cross-sectional side elevational view of the emergency pack taken at section line 9-9 in FIG. 4, further showing an inner package of the emergency pack connected with an outer package of the emergency pack according to one embodiment of the disclosure, the inner package shown with a liquid material disposed therein.
Figure 10:
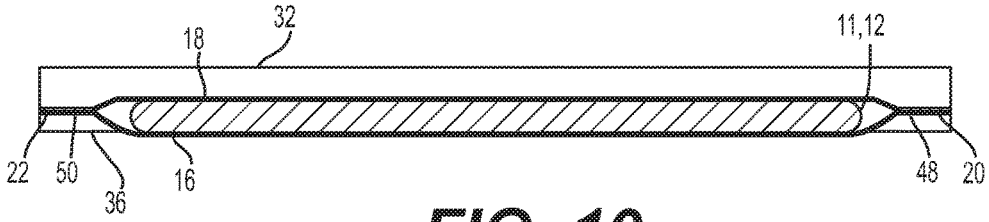
FIG. 10 is a cross-sectional side elevational view of the emergency pack taken at section line 10-10 in FIG. 4, the inner package of the emergency pack shown consisting of a solid material.

As established hereinabove, the inner package 12 either is the item 11 for aerial delivery, or houses the item 11 for aerial delivery. As shown in FIG. 9, where the inner package 12 houses the item 11 for delivery, for example, water, the inner package 12 may be coupled with the outer package 14. In particular, a top edge 44 and a bottom edge 46 of the inner package 12 may be sealed between the sheets 16, 18 with a top transverse seal 48 and a bottom transverse seal 50, respectively. As shown in FIG. 10, where the inner package 12 is the item 11 for aerial delivery, the inner package may be loosely disposed between the sheets 16, 18 of the outer package 14. A plurality of the items 11 individually, or packaged within a plurality of the inner packages 12, may also be substantially evenly distributed within the outer package 14 of the pack 10. It should also be appreciated that the inner packages 12 may also be substantially evenly distributed along a length of the outer package 14 in order to provide a balanced weight distribution and facilitate the delivery of the pack 10 through the air. Other means for disposing the inner package 12 within the outer package 14 of the pack 10, and any number of items 11, may be used as desired. Furthermore, more than one inner package 12 may be disposed throughout outer package 14. Preferably, the inner packages are disposed evenly to evenly distribute the weight throughout outer package 14. In a preferred embodiment, item 11 is allowed to move freely within inner package 12. In a preferred embodiment, pack 10 holds 100 grams, 200 grams, 300 grams, 400 grams, 750 grams, 1 kilogram, 2 kilograms or another amount of item 11. The size, flexibility, aerodynamic element(s), material, and positioning of item 11 can all be adjusted depending on the weight and contents of item 11. Furthermore, item 11 can be position so that pack 10 has a positive static stability, a neutral static stability, or a negative static stability.

Preferably, the contents of pack 10 is a single serving or ration of item 11. For example, the contents can be a single serving of water, a single nutrition bar, a first aid kit, or a sanitation kit. In embodiments where pack 10 holds a single serving of item 11, distribution of the packs is achieved during the airdrop since the packs will preferably be evenly and randomly distributed across the drop zone.

It is understood that the various seals 20, 22, 24, 26, 28, 30, 36, 38, 48, 50 of the present disclosure may be formed by a chemical sealing operation, such as by use of an adhesive or a chemical solvent, for example, or by a heat welding operation, as desired. In particularly illustrative embodiments, the various seals 20, 22, 24, 26, 28, 30, 36, 38, 48, 50 are formed by heat sealing operations. Alternative means for forming the various seals 20, 22, 24, 26, 28, 30, 36, 38, 48, 50 may also be employed, as desired.

The pack 10 of the present disclosure may further include a perforation 52 to facilitate an opening of the pack 10. The perforation 52 may be a tamper-proof or tamper-evident perforation 52. The perforation 52 may extend inwardly from an edge of the emergency pack and traverse at least one of the top edge seal 20, the bottom edge seal 22, the top transverse seal 48, and the bottom transverse seal 50, in order that the same seals may be opened to permit access to the inner package 12 and the item 11 for aerial delivery by an end user of the pack 10. Additional, perforations may be added to form a pouch with a carrying handle.

As established herein, the outer package 14 is adapted to contain the inner package 12. The outer package 14 may also contain an illuminating device to facilitate visible location of the pack 10, particularly at night, such as a flashing LED, glowing film, or a reflective device, for example. The illumination device may be activated by time, temperature, pressure, or impact, for example. Alternatively, the outer package 14 may be formed from a radar reflective material or a radar dissipating coating. In certain embodiments, the outer package 14 is formed from or coated with a light-activated substance. The outer package 14 may also contain a tracking device such as a GPS device, an RFID device, and the like to facilitate tracking of the pack 10 or for inventory control. Furthermore, the packaging may contain a noise generating device. For example the packaging may contain a whistle, buzzer, or beeper that is activated as the air passes over the packaging, electrically, or mechanically. The noise generating device can announce the arrival and location of the packs as they drop or at the drop location. The noise generating device may be a speaker that can play a pre-recorded message. In certain embodiments, pack 10 has no moving parts, electric parts, or mechanical parts.

The outer package 14 may include and/or contain indicia. The indicia may include a colored material or a symbol to indicate the contents thereof. For example, blue indicium may indicate that the item 11 is water, a Red Cross indicium may indicate that the item 11 includes medical supplies, and the like. The indicia may also include instructions in a plurality of languages or graphical instructions for opening the pack 10 and to indicate the use of the contents thereof. In certain embodiments, the packs 10 may be colored. For example, the packs 10 may be blue, maroon, yellow, beige, or patterns such as plaid or polka-dotted. Additionally, the pack 10 may have a solar film with a printed circuit device coupled to the pack. The device can be used for communication and/or navigation proposes by receiving and sending AM/FM or shortwave signals.

As shown in FIGS. 11-27D, the present disclosure also includes systems 100 for producing or sealing a pack 10 or another package. Other types of packs 10 may also be manufactured with the system 100 of the present disclosure, for example envelops, bags, boxes, bottles, or other containers. Preferably, the system is a remote packing system (RPS). The RPS is a production module that processes the insertion of a payload into a pack and seals the pack prior to being loaded into a deployment container. Preferably, the RPS provides fast, reliable, and efficient production capacity in any location. The RPS can be manually operated, semi automated, automated or part of a robotic assembly. Preferably the RPS is positioned on a stand 1160. The RPS can be used to pre-create packs or create packs on an as-needed basis.

In a preferred embodiment, empty packs are provided to the operator of the RPS. Preferably, the empty packs have one edge that is open, however more than one edge can be open. The user of the RPS preferably fills each pack with a desired payload and then uses the RPS to seal the remaining open edge. The packs can be filled in an automated process, by hand, or another method. The RPS may be able to determine which edge is open and properly orient the pack to seal the open edge. The RPS may use gravity to position and hold in place the pack during sealing or the RPS may use a conveyor to load and seal the RPS. The RPS may use glue, heat sealing, other adhesive, welding or another sealing method.

Figure 11:
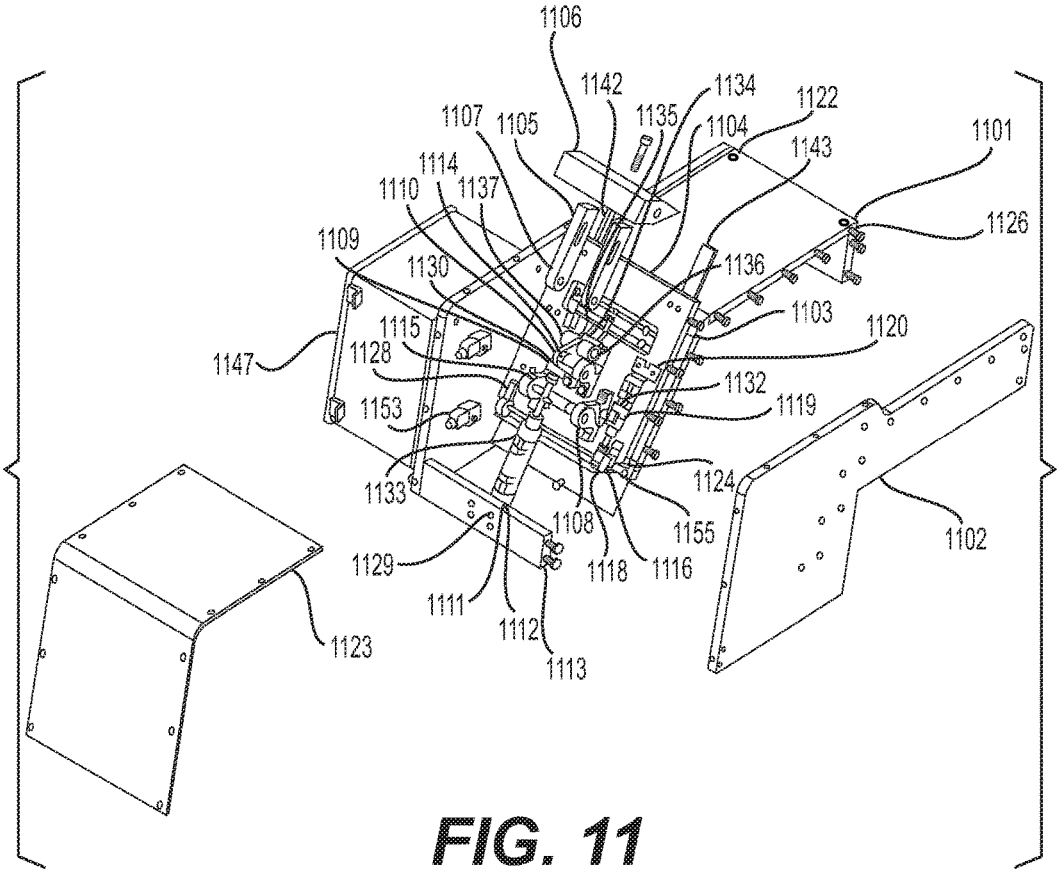
FIG. 11 is an exploded view of a machine for sealing the packs.
Figure 12:
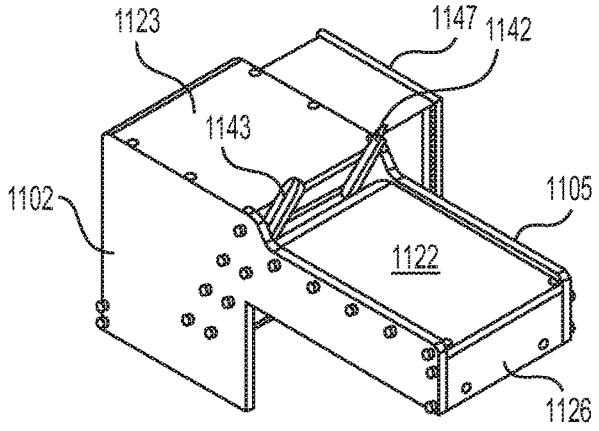
FIGS. 12-20 depict additional views of the machine of FIG. 11.
Figure 13:
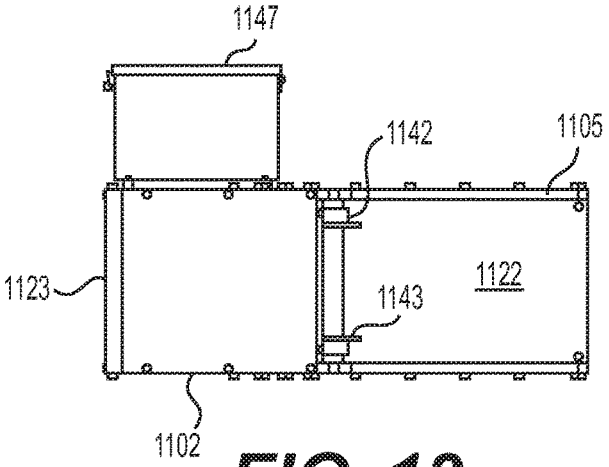
Figure 14:
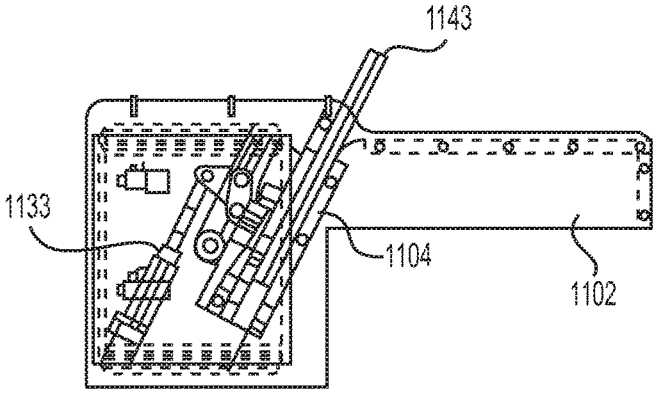
Figure 15:
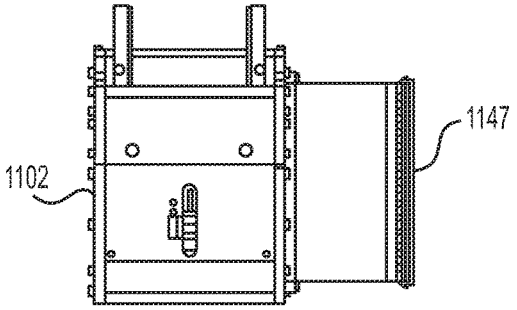
Figure 16:
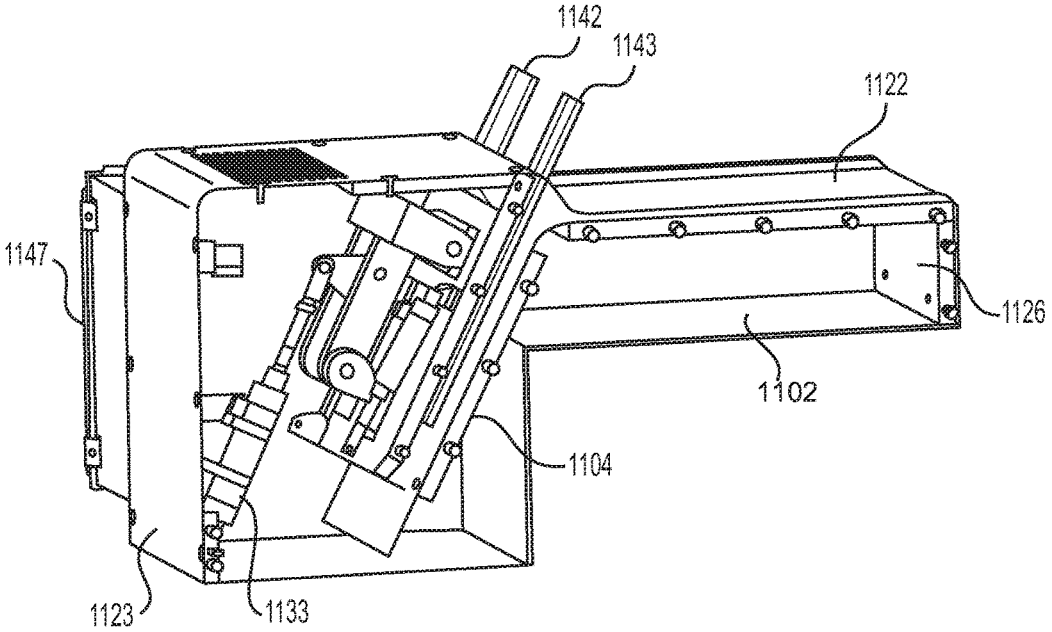
Figure 17:
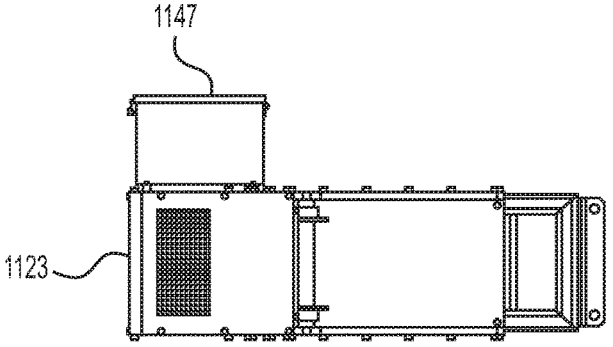
Figure 18:
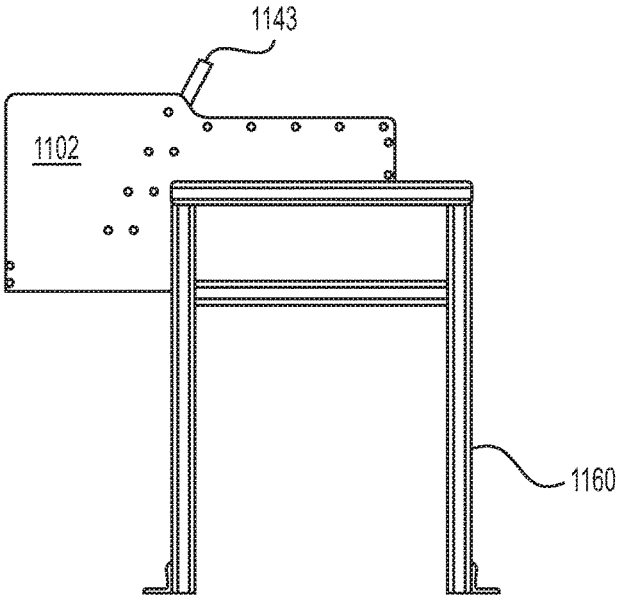
Figure 19:
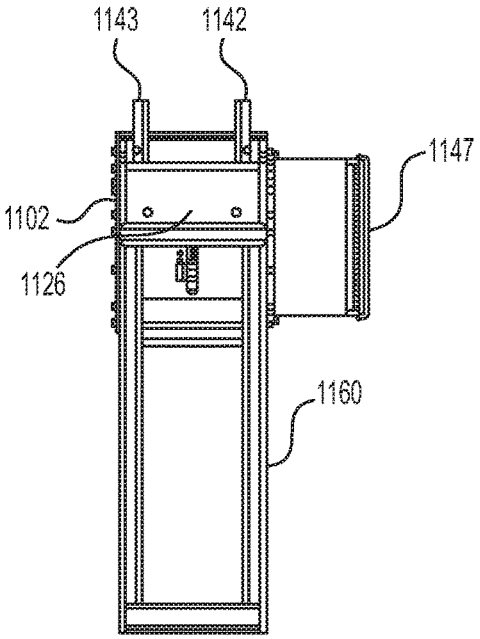
Figure 20:
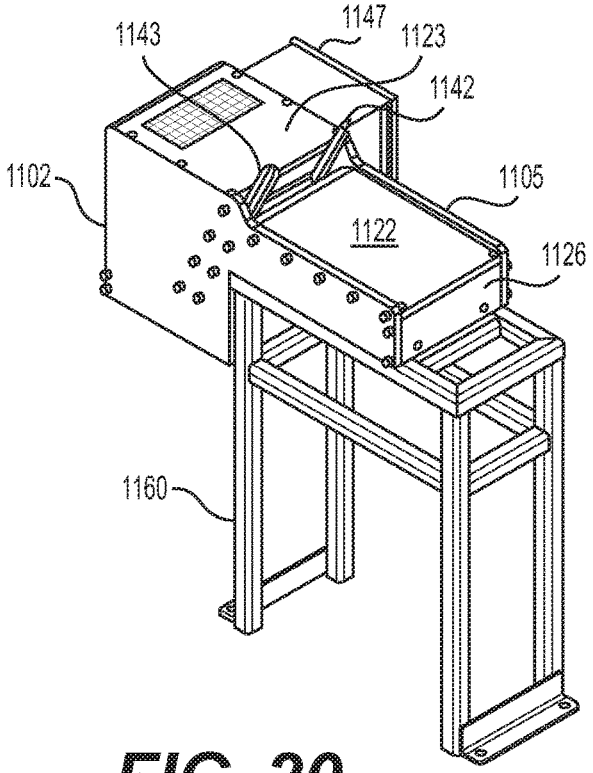
Figure 21:
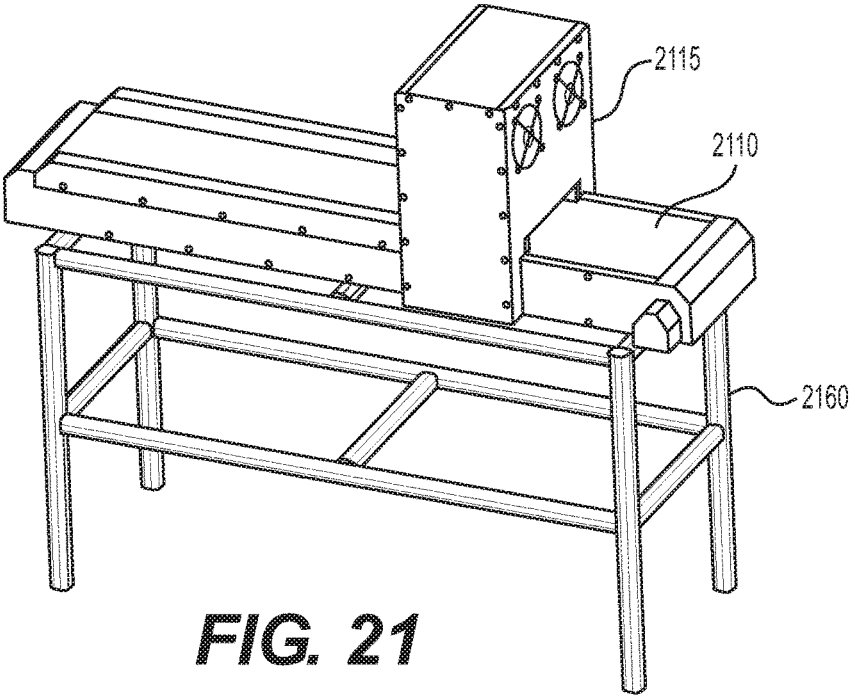
FIGS. 21-23 depict views of a second embodiment of a machine for sealing packs.
Figure 22:
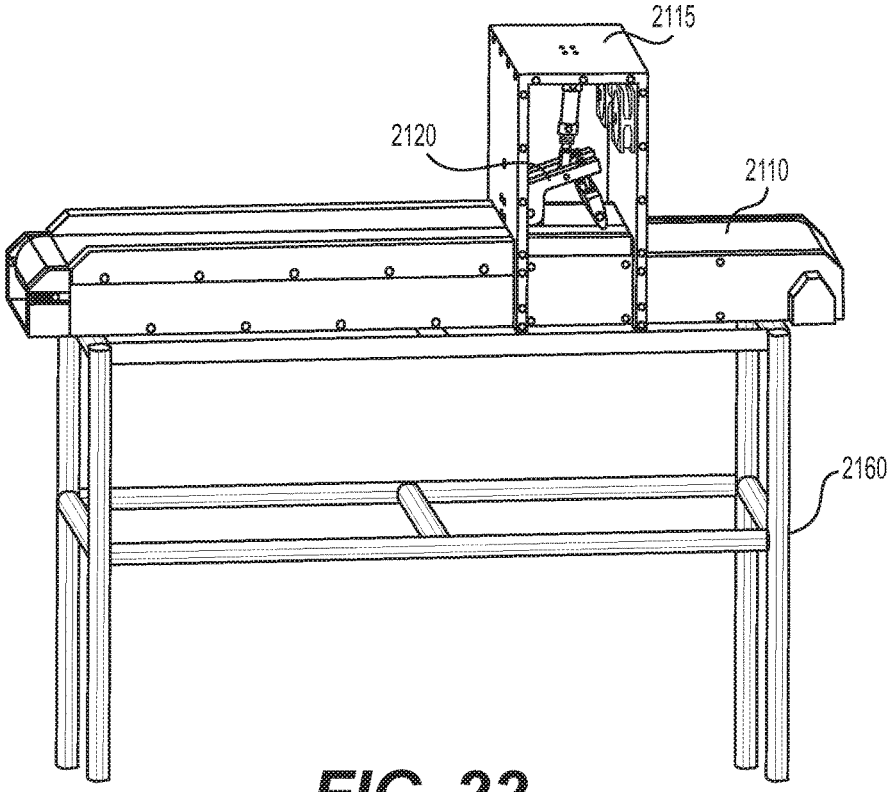
Figure 23:
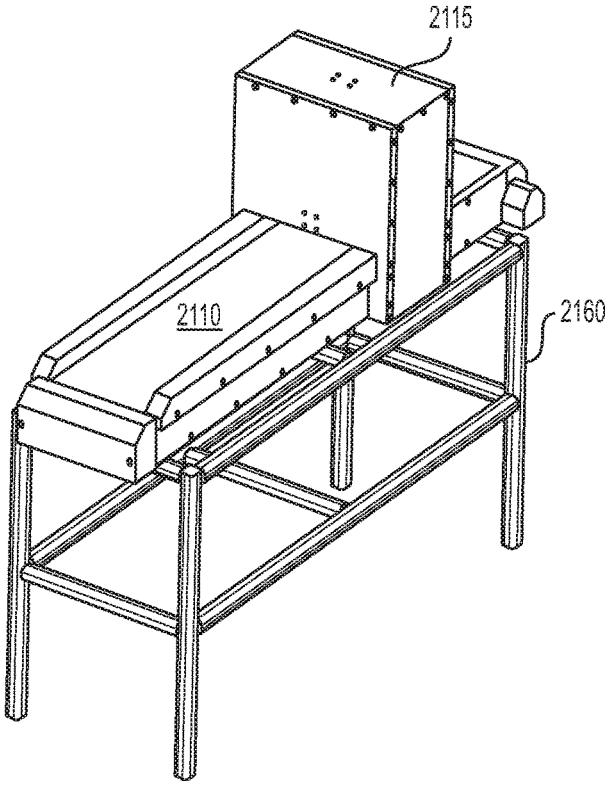

FIG. 11 displays an exploded view of a first embodiment of a machine for sealing the packs 10 disclosed herein. FIGS. 12-20 display additional views of the machine. Table 1 is a list of elements that may be included in the manufacturing machine.

TABLE 1

| No. | Element |
|---|---|
| 1 | Base Plate |
| 2 | Side Plate |
| 3 | Anvil Plate |
| 4 | Mounting Plate |
| 5 | Side Plate |
| 6 | Sealing Head |
| 7 | Heat Seal Actuator Arm |
| 8 | Seal Arm Pivot Block |
| 9 | Actuator Plate Pivot Block |
| 10 | Rod Clevis for 1½" Bore Air Cylinder |
| 11 | 1½" Bore × 3" Stroke Air Cylinder |
| 12 | Pivot Bracket with Pin |
| 13 | Lower Cross Bar |

TABLE 1-continued

| No. | Element |
|---|---|
| 14 | Flanged Sleeve Bearing |
| 15 | Seal Arm Pivot Shaft |
| 16 | Eject Door Pivot Block |
| 17 | Eject Door Pivot Plate |
| 18 | Rod Clevis with Pin |
| 19 | 1 1/16Bore × 1½" Stroke Air Cylinder |
| 20 | Pivot Bracket with Pin |
| 21 | Eject Door Plate |
| 22 | Slide Plate |
| 23 | Cover Guard |
| 24 | Flanged Sleeve Bearing |
| 25 | Eject Door Pivot Rod |
| 26 | Front Cross Attachment Plate |
| 27 | ¼20 × ½ Button Head Cap Screw |
| 28 | ¼20 × 1 SHCS |
| 29 | ¼20 × ⅞ SHCS |
| 30 | ⅜16 × 1 SHCS |
| 31 | ⅜16 × 2¼ SHCS |
| 32 | Reed Switch for 1 1/16" Bore Cylinder |
| 33 | Reed Switch for 1½" Bore Cylinder |
| 34 | Heat Seal Actuator Plate |
| 35 | Cam Follower Mount |
| 36 | Actuator Plate Pivot Shaft |
| 37 | Cam Follower |
| 38 | Micro Switch Mount Block |
| 39 | Micro Limit Switch |
| 40 | 6-32 × 1 SHCS |
| 41 | ⅜16 × 1½ Socket Head Cap Screw |
| 42 | L.H. Spreader Rail |
| 43 | R.H. Spreader Rail |
| 44 | Fiberglass/Silicone Fabric Heat Seal Cover |
| 45 | Sealing Fabric Clamping Rod 0.170" Dia × 8" Long |
| 46 | 10-24 × ½ Flanged Button Head Stainless Steel Cap Screw |
| 47 | 47 7605K43 1 Electrical Enclosure 14 × 12 × 8 |
| 48 | 48 92510A780 4 Aluminum Unthreaded Spacer ½ I.D × Long ⅜O.D. × ⅝ |
| 49 | ¼20 × 1¼ SHCS |
| 50 | 101-550-000-0 |
| 51 | 105-313 |
| 52 | 104-902 |
| 53 | DIN Plug In |
| 54 | Endcap |
| 55 | Shim Plate |
| 56 | Socket Head Cap Screw |

Preferably, the RPS is contained within a base plate 1101, two side plates 1102 and 1105, an anvil plate 1103, and a cover guard 1123. Mounting plate 1104 is positioned above anvil plate 1103 and separated therefrom by spreader rails 1142 and 1143. Preferably, packs are loaded onto slide plate 1122, which feeds the packs between anvil plate 1103 and mounting plate 1104. Preferably anvil plate 1103 and mounting plate 1104 are at an angle to slide plate 1122, thereby using gravity to cause the packs to fall into position during loading.

Sealing head 1106 is preferably then moved into position by heat seal actuator arm 1107 and seal arm pivot block 1108, which are preferably mounted on heat seal actuator plate 1134. The positioning of heat seal actuator plate 1134 is preferably controlled by actuator plate pivot block 1109, which rotates about actuator plate pivot shaft 1136. Preferably, the movement of the various components of the RPS are made using hydraulic pistons (e.g. stroke air cylinder 1111), cams, actuators, electronics, or other devices. Once the pack and the sealing head 1106 are properly positioned, sealing head 1106 preferably seals the pack. The sealing can be accomplished with adhesive, heat, lasers, stitching, fasteners, or another sealing method. Once the pack is sealed, it is preferably ejected out of the RPS via eject door plate 1121. Preferably, the sealed pack is allowed to slide out of the RPS via gravity.

In the preferred embodiment, the remote packing machine or system operator turns machine on, which in turn powers on light lights, a heater begins to get hot, and a "Heat Not Ready" light turn on. Preferably the unit cannot cycle until it reaches a predetermined temperature. Once the machine reaches a proper temperature set point, a "Heat Ready" light turns on. In the preferred embodiment, the operator loads a filled pack in to machine and presses a "pack strikes cycle" start switch. In other embodiments the machine receives filled packs from a conveyor belt or is part of an automated system that automatically fills the packs and feeds them to the RPS. Depending on the components attached to the RPS, the system may have different levels of automation. A seal and cycle timer activates, a "unit in cycle" light turns on, and the seal head extends. Once the seal timer completes, the seal head retracts and an ejection chute opens. As the cycle timer completes, the ejection chute closes, and cycle is complete, as indicated by the "unit in cycle" light turning off. The sealed packs can then be stored or prepared for deployment.

FIGS. 21-23 and 24-28 depict various views of two versions of a second embodiment of the RPS with an integrated conveyor belt. Preferably, the RPS is a high speed system capable of repeatedly sealing multiple packs in succession. As the packs move along the conveyor belt, they are filled (either manually or automatically) and then sealed. The sealed packs can then be stored or prepared for deployment. In the embodiment shown in FIGS. 21-23, the packs are sealed using a pneumatically driven sealing device. While in the embodiment shown in FIGS. 24-28 the packs are sealed with an electronic sealing device. The embodiment shown in FIGS. 24-28 includes an all-electric system, driven by an electric motor and mechanical linkage, eliminating the pneumatic actuation used in the first two embodiments. The RPS may also include an electronic, laser or light based, device to detect the presence of the pack to initiate the machine cycle.

Figure 24:
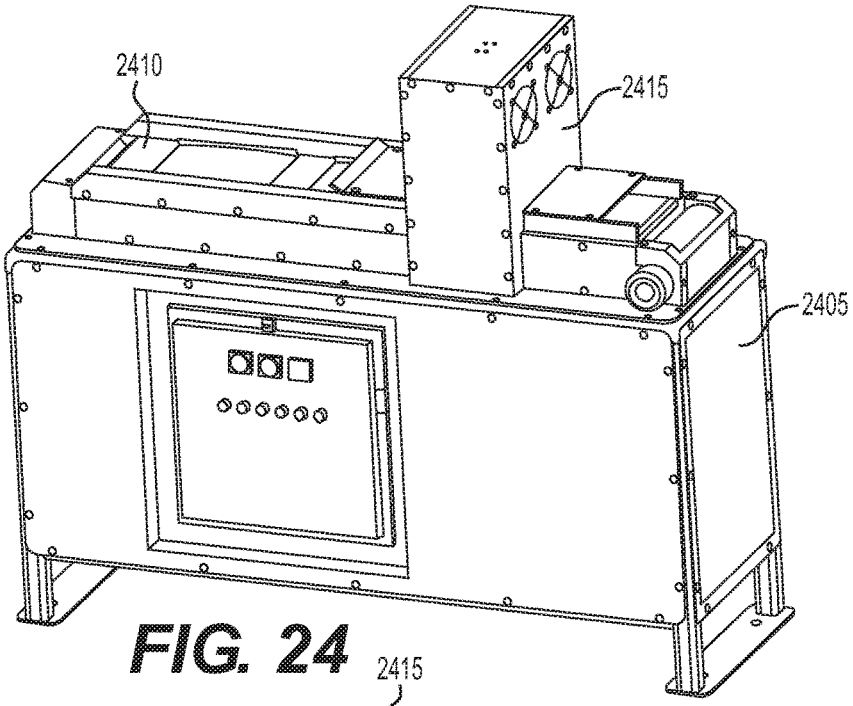
FIGS. 24-28 depict views of a third embodiment of a machine for sealing packs.
Figure 25A:
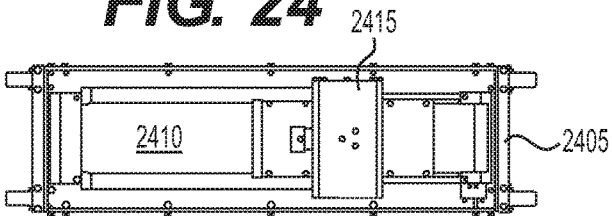
Figure 25B:
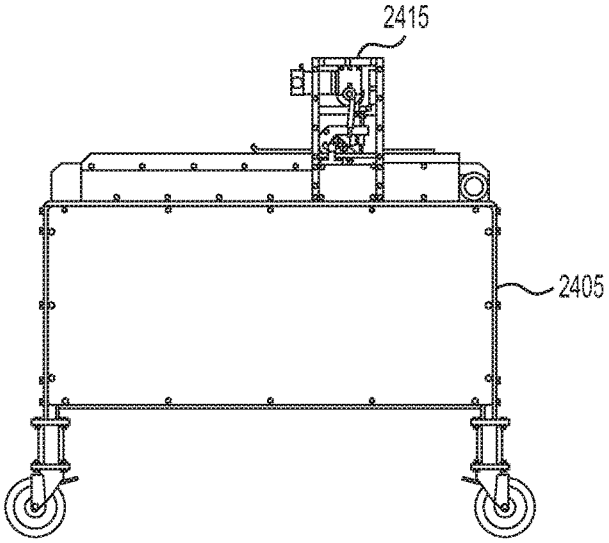
Figure 25C:
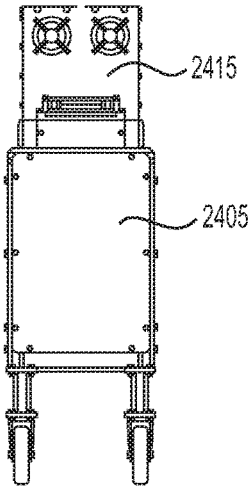

As depicted in FIG. 24, the RPS is preferably comprised of a base 2405 supporting a conveyor belt 2410. The base 2405 may contain the components for controlling the RPS and driving the conveyor belt 2410. Preferably, above the conveyor belt 2410 is the sealing mechanism housing 2415 containing the sealing mechanism shown in FIGS. 27A-D. Preferably conveyor belt 2410 also has various guides to control the positioning of the packs as they are fed through the RPS. FIGS. 25A-25C show top, side, and front views of the RPS, respectively. The RPS may be movable (e.g. on casters as shown in FIGS. 25A-C) or be affixed to the floor.

Figure 26A:
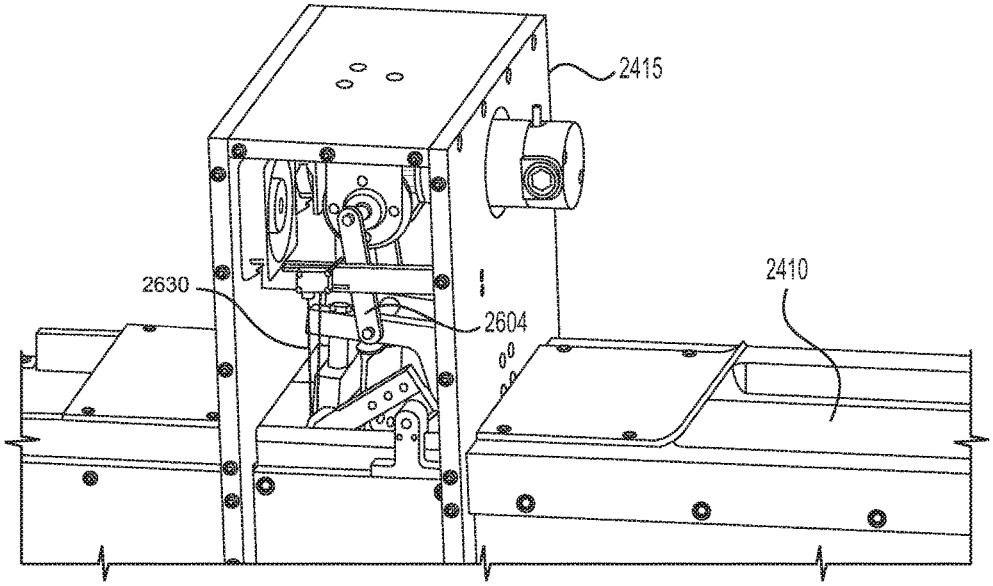
Figure 26B:
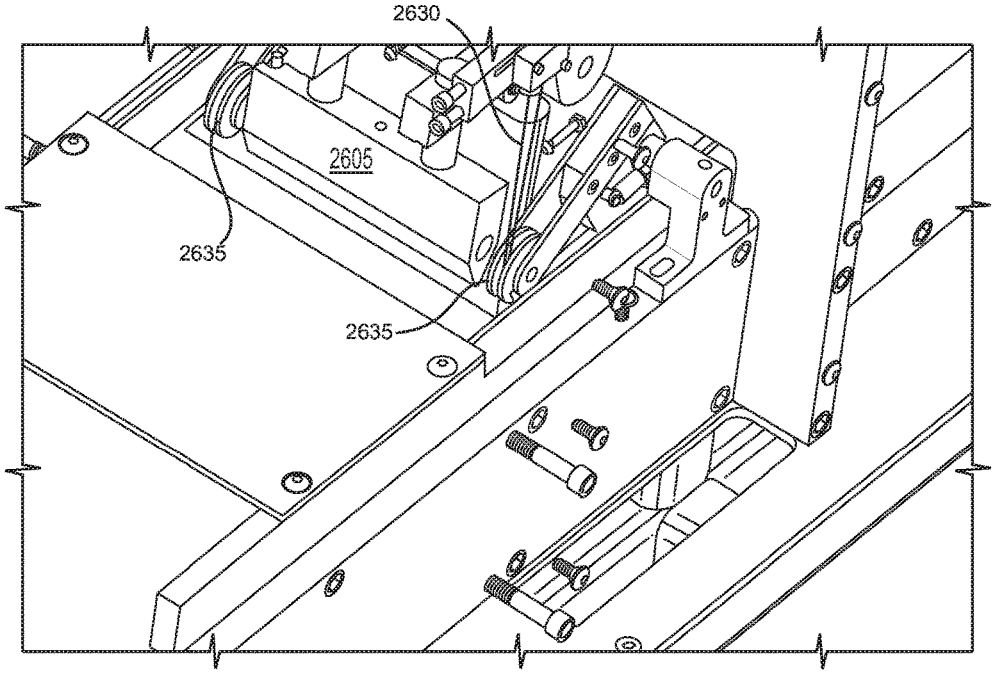
Figure 27A:
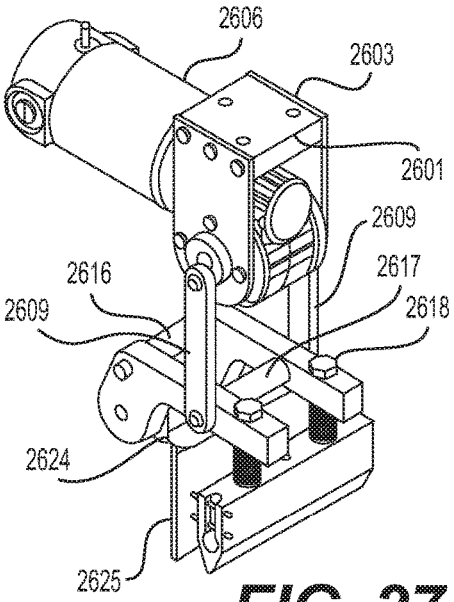
Figure 27B:
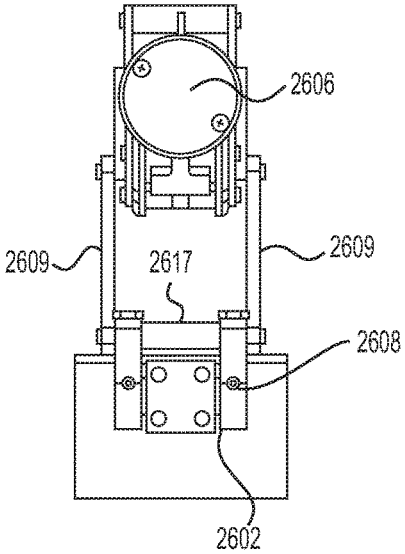
Figure 27C:
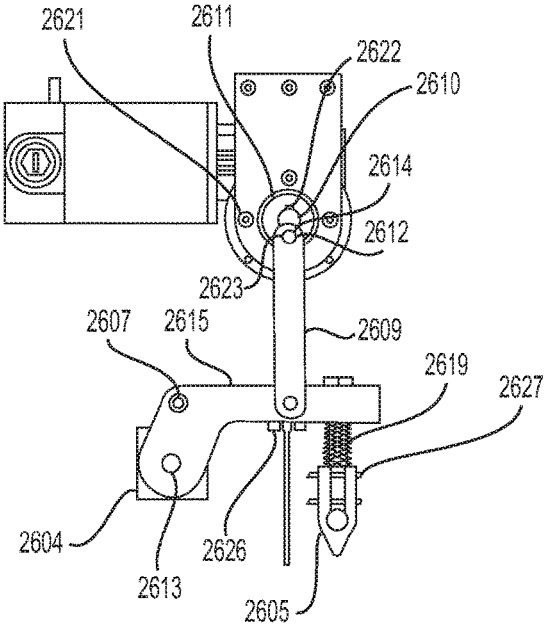
Figure 27D:
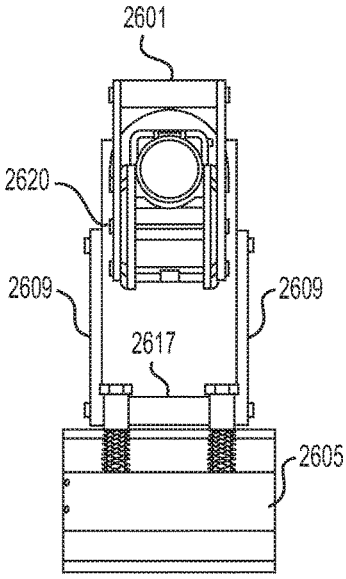

FIGS. 26A and 26B are close-up, cut-away views of the sealing mechanism housing 2415 and FIGS. 27A-27D are various views of the sealing mechanism itself. Table 2 is a list of elements that may be included in the sealing mechanism.

TABLE 2

| No. | Element |
|---|---|
| 1 | Motor Mount Block |
| 2 | Flanged Bushing |
| 3 | Motor Support Plate |
| 4 | Pivot Block |
| 5 | Heat Seal Bar |
| 6 | Gearmotor |
| 7 | Stainless Steel SHCS (Socket Head Cap Screw) |
| 8 | Flat Point Set Screw |
| 9 | Drive Link |
| 10 | Drive Shaft |

TABLE 2-continued

| No. | Element |
|---|---|
| 11 | Eccentric Hub |
| 12 | Eccentric Pin |
| 13 | Pivot Shaft |
| 14 | Sleeve Bearing |
| 15 | Pivot Arm |
| 16 | Tie Rod |
| 17 | Actuator Shaft |
| 18 | Hex Head Shoulder Screw |
| 19 | High-Load Compression Spring |
| 20 | Flat Point Set Screw with Thread Lock |
| 21 | Low-Profile SHCS |
| 22 | Round Bottom Woodruff Key |
| 23 | External Retaining Ring |
| 24 | Strip Brush Holder |
| 25 | Brass Bristle Strip Brush |
| 26 | SHCS |
| 27 | Cotter Pin |

In a preferred embodiment, as the packs traverse the conveyor belt 2410, they pass under the sealing mechanism. The sealing mechanism may run at regular intervals or may run as required. For example, the mechanism may activate to seal a pack once an imaging device (such as a laser, a high speed digital camera, a light detection device, or another device) determines that a pack is properly positioned below the sealing mechanism for the sealing mechanism to seal the pack. For example, as can be seen in FIG. 26B, a laser beam 2630 may be used to scan for the edge of an incoming pack and, once the edge of a pack is detected, the RPS may begin the sealing process.

Upon activation, the gearmotor 2606, which is preferably held in place by the motor mount block 2601 and the motor support plates 2603, preferably causes eccentric hub 2611 to rotate about drive shaft 2610. As eccentric hub 2611 rotates, drive link 2609 preferably translates the rotational movement of eccentric hub 2611 into a linear movement. Drive link 2609 preferably causes pivot arm 2615 to pivot about pivot shaft 2613. As pivot arm 2615 moves, it causes brass bristle strip brush 2625 and heat seal bar 2605 to rise and lower. Preferably, brass bristle strip brush 2625 forces a pack closed as heat seal bar 2605 seals the pack. Additionally, there may be rollers 2635 (shown in FIG. 26B) that help close and flatten the pack and guide it through the sealing mechanism. Rollers 2635 may have central cutouts or indentations to allow laser beam 2630 to pass though uninterrupted. By allowing laser beam 2630 to pass through rollers 2635, the system can detect the point of contact between the leading edge of a pack and the rollers 2635. The laser may be positioned to point next to rollers 2635 in other embodiments. By detecting when a pack is tangential to a roller 2635 the system can better determine when to initiate the sealing process. The sealing can also be accomplished with adhesive, lasers, stitching, fasteners, or another sealing method. Once a pack is seal, it preferably continues down the conveyor belt and off of the RPS. Preferably, packs are sealed continuously without the need to stop or slow the conveyor belt.

Figure 28:
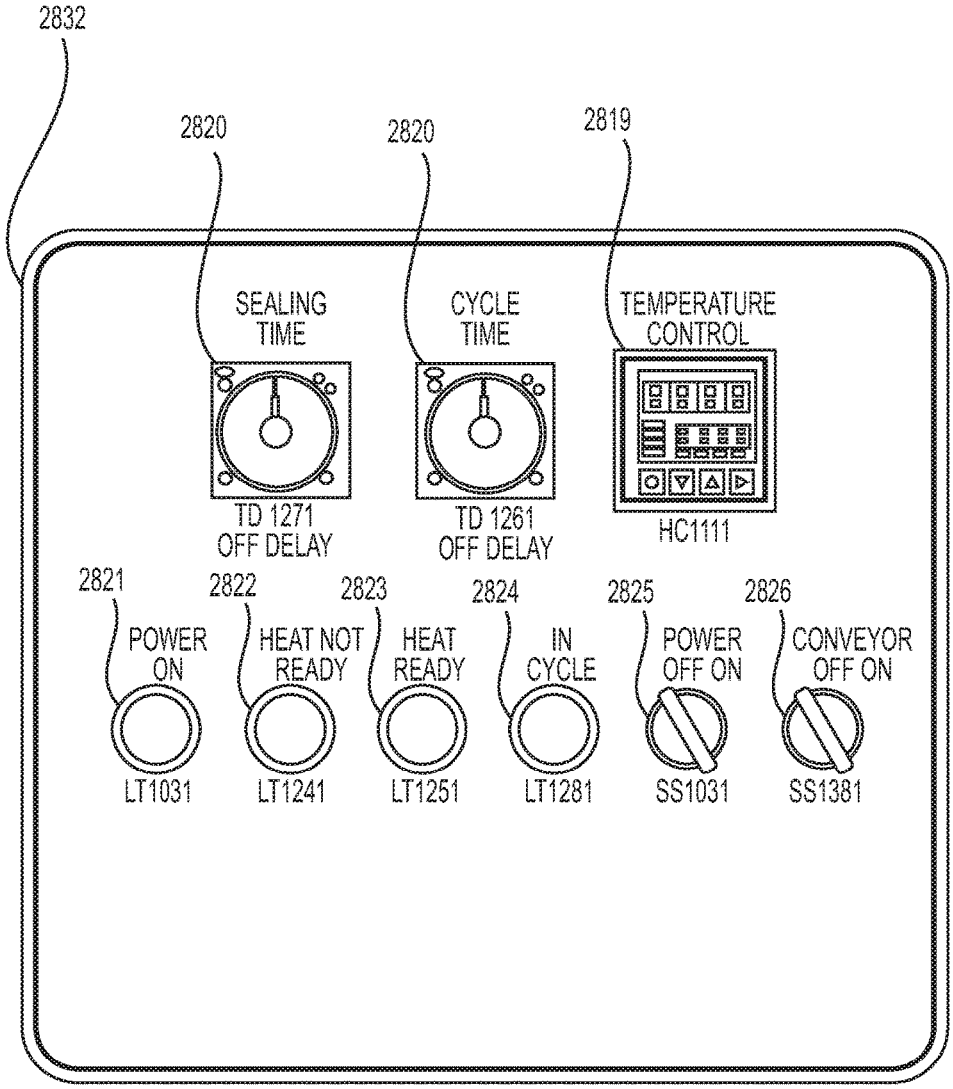

Operators of the RPS may be able control the speed of the conveyor, the sealing time, the run time of the RPS, the temperature of the sealing, and other factors in sealing the packs. For example, FIG. 28 depicts a control panel 2832 for running an RPS. The control panel 2832 may have controls or displays for the sealing time and cycle time 2820, temperature controls 2819, indicator lights 2821-2824, and power switches or controls 2825 and 2826. Preferably, the RPS is capable of sealing up to 30 packs a minute, up to 60 packs a minute, up to 120 packs a minute, up to 360 packs a minute, or more. Preferably, the RPS is powered by connection to an electrical power source. However, the RPS may be powered by one or more batteries, natural power sources (e.g. sun, wind, or water), or human powered.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. It is intended that the specification and examples be considered exemplary only with the true scope and spirit of the invention indicated by the following claims. Furthermore, the term "comprising" includes the terms "consisting of" and "consisting essentially of," and the terms comprising, including, and containing are not intended to be limiting.

The invention claimed is:

1. A device for sealing packages, comprising:

a conveyor belt; and a sealing mechanism positioned above the conveyor belt, wherein the sealing mechanism is comprised of:

a motor;

a drive shaft rotated by the motor;

an eccentric hub coupled to the drive shaft;

a drive link coupled to the eccentric hub and adapted to translate rotational motion into linear motion;

a pivot arm coupled to the drive link;

a sealing bar coupled to the pivot arm and adapted to seal the packages as the packages pass under the sealing mechanism;

a laser imaging device adapted to determine if a package is properly positioned under the sealing mechanism prior to sealing the package; and guide wheels, wherein at least one guide wheel is notched to allow the laser to pass through the guide wheel uninterrupted.

2. The device of claim 1, wherein the sealing mechanism further comprises a strip brush coupled to the pivot arm and adapted to close each package as the package is sealed.

3. The device of claim 1, wherein the sealing mechanism is one of electrically driven or pneumatically driven.

4. The device of claim 1, wherein the conveyor belt is positioned on a stand.

5. The device of claim 4, wherein the stand is movable.

6. The device of claim 1, wherein a plurality of packages are sealed continuously without stopping or slowing the conveyor belt.

7. The device of claim 1, wherein the sealing bar applies heat to each package to seal the package.

8. The device of claim 1, wherein the packages are automatically or manually filled prior to being sealed.

9. The device of claim 1, wherein the packages are only open along one edge prior to being fed into the device.

10. The device of claim 1, wherein an operator of the device is able to control at least one of a conveyor speed, a sealing time, a run time, and a temperature of the sealing.

11. The device of claim 1, wherein the device is transportable as a single unit.

* * * * *